US007624550B2

(12) United States Patent
Ospina

(10) Patent No.: US 7,624,550 B2
(45) Date of Patent: Dec. 1, 2009

(54) INTEGRAL COMPOSITE-STRUCTURE CONSTRUCTION SYSTEM

(76) Inventor: Pedro Ospina, Picaflo 1066 Y Platero Campo Anlegr, Monteserrin, 17-04-10623, Quito (EC)

( * ) Notice: Subject to any disclaimer, the term of this patent is extended or adjusted under 35 U.S.C. 154(b) by 527 days.

(21) Appl. No.: 11/306,969

(22) Filed: Jan. 17, 2006

(65) Prior Publication Data

US 2008/0083181 A1 Apr. 10, 2008

(51) Int. Cl.
*E04B 5/16* (2006.01)
*E04B 5/43* (2006.01)

(52) U.S. Cl. ..... 52/334; 52/262; 52/299; 52/331; 52/333; 52/335; 52/341; 52/351; 52/600; 52/687

(58) Field of Classification Search ..... 52/837, 52/838, 334, 327, 328, 331, 332, 333, 335, 52/340, 341, 677, 679, 687, 600, 602, 351, 52/251, 262, 299, 630, 376, 649.1, 649.8, 52/831

See application file for complete search history.

(56) References Cited

U.S. PATENT DOCUMENTS

| | | | | |
|---|---|---|---|---|
| 3,596,421 | A | 8/1971 | Miller | |
| 3,736,716 | A * | 6/1973 | Nishimura | 52/334 |
| 4,115,971 | A * | 9/1978 | Varga | 52/334 |
| 4,527,372 | A | 7/1985 | Ryan | |
| 4,584,803 | A * | 4/1986 | Ryan | 52/220.4 |
| 4,592,184 | A | 6/1986 | Person | |
| 5,544,464 | A | 8/1996 | Dutil | |
| 5,595,034 | A * | 1/1997 | Krysalka et al. | 52/318 |
| 5,809,722 | A * | 9/1998 | Bertsche | 52/334 |
| 5,918,428 | A * | 7/1999 | Hough | 52/127.3 |
| 6,112,482 | A | 9/2000 | Wright | |

* cited by examiner

*Primary Examiner*—Richard E Chilcot, Jr.
*Assistant Examiner*—Chi Q Nguyen
(74) *Attorney, Agent, or Firm*—Jeffrey Furr; Furr Law Firm

(57) ABSTRACT

Composite structural system for floors or roofs comprising steel beams and reinforced concrete slab or shear walls comprising steel columns and reinforced concrete diaphragms. In both cases a steel plate with holes crossed with rebars is welded to the steel beam or to the steel column which performs the integral combination of the concrete, the structural element and the rebars.

1 Claim, 5 Drawing Sheets

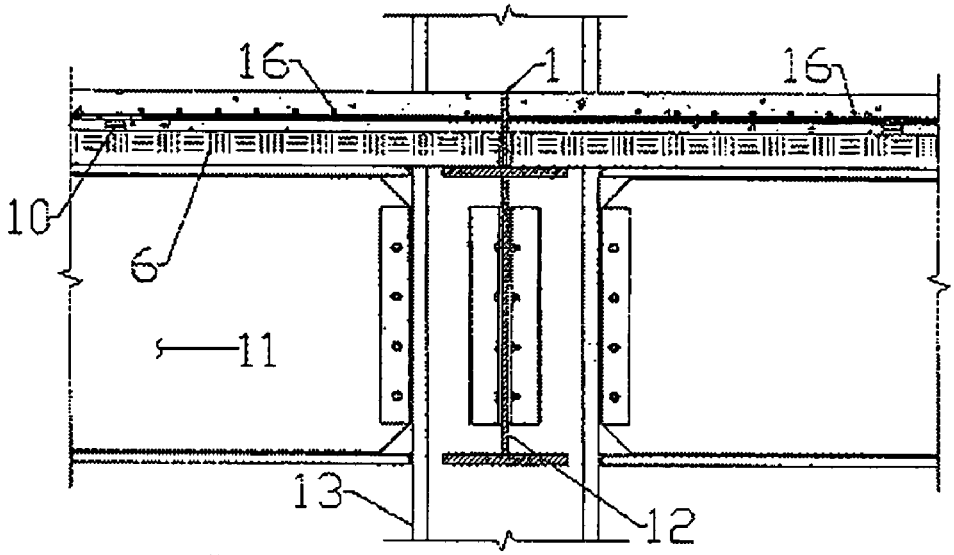
FIG. 6.- SECCION A-A
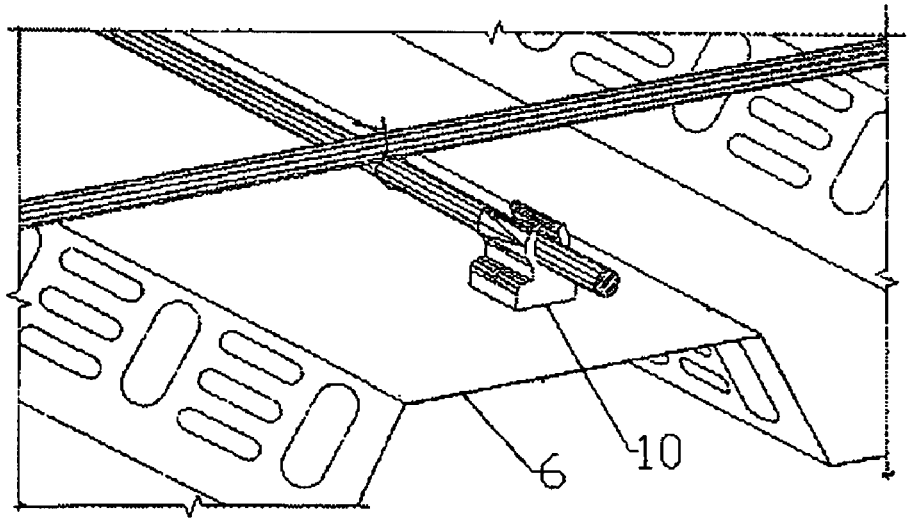
FIG. 7

INTEGRAL COMPOSITE-STRUCTURE CONSTRUCTION SYSTEM

FIELD OF THE INVENTION

This invention significantly increases the efficiency of structural composite systems applied to building construction. The construction of floors or roofs of composite structure for buildings requires the combination, by means of connectors, of steel beams and reinforced concrete slabs; for the construction of shear walls, which have to resist the horizontal forces applied to the composite structure of a building, the system requires to combine steel columns with reinforced concrete diaphragms.

DESCRIPTION OF THE PRIOR ART

U.S. Pat. No. 4,592,184 considers a vertical plate connector with protrusions but without holes so the horizontal longitudinal shear of the composite beam is taken only by sliding friction and bond; the welded wire fabric has the objective of controlling the cracks that could appear along the plate-connector but it is not meant to take the slab negative bending nor to work as plate-connector of the composite steel-beam-reinforced-concrete-slab system. The same happens with U.S. Pat. No. 5,544,464 where the beam's "s" shaped plate-connector lacks of holes and the welded wire fabric is not there to take the slab's negative flexural bending.

U.S. Pat. No. 4,527,372 does not use a plate-connector: it uses the conventional stud connectors; also, it does not use wire fabric or any other type of reinforcement to solve the negative flexural bending of the slab; it only modifies the steel deck edges to avoid leaking during concrete pouring.

In U.S. Pat. No. 6,112,482, steel deck is supported at the bottom flange of the beam and, instead of using shear connectors, it uses grooves on the top flange and simple bond on the beam's web in order to solve the horizontal longitudinal shear and there are no holes nor longitudinal plate-connector, so the system limits itself to beams of minor spans because the deck's depth limits the beam's span.

Patent EP1227198A2 considers an inverted T profile with two types of holes in the web of the T: closed holes and open holes; the closed holes are useful for generating the "perfobond effect" which generates "concrete dowels" which helps in taking the horizontal longitudinal shear of the composite beam, shear strength based exclusively on the shear strength of concrete. "U" shaped holes facilitates the installation of the welded wire fabric from above; these welded wire fabric's transverse rebars take the negative flexural bending of the slab and for this reason the inventor splices them with the rebars of the prefabricated reinforced concrete planks but in no case he considers these transverse rebars, nor could do so, as the beam's horizontal connectors; for this reason this composite system can only be used for small spans and loads because longitudinal shear capacity is limited by the strength due to the sliding friction or bond between the steel of the beam and the concrete, which are numerically similar, and concrete's longitudinal shear strength. Even though this composite system has holes in its plate-connector, this system does not use rebars as connectors since it uses the welded wire fabric, so the bearing concept on the holes can not he applied because the diameter of the rebars of the wire fabric is much smaller than the holes' diameter. "U" holes are constructively attractive because they allow to place the wire fabric from above which also makes the shear strength of reinforced concrete to be incremented by the wire fabric rebars' shear strength, but these rebars do not work as connectors.

U.S. Pat. No. 3,596,421 uses an omega profile mounted on the web of an inverted T profile. The omega profile's flanges support, at each side, the steel deck; over the edge of the omega profile a wave shaped rebar is welded; this rebar will take the horizontal longitudinal shear of the composite beam, but they are not intended to take the slab's flexural bending and here is the difference with the proposed system.

Finally, none of these patents has a device for leveling the slab or the diaphragm thickness; neither have they fixed the position of the welded wire fabric.

There is still room for improvement in the art.

SUMMARY OF INVENTION

Composite structural system for floors or roofs comprising steel beams and reinforced concrete slab or shear walls comprising steel columns and reinforced concrete diaphragms. In both cases a steel plate with holes crossed with rebars is welded to the steel beam or to the steel column which performs the integral combination of the concrete, the structural element and the rebars.

BRIEF DESCRIPTION OF DRAWINGS

Without restricting the full scope of this invention, the preferred form of this invention is illustrated in the following drawings:

FIG. 6. Shows A-A cross section of the connection of the frame beams with the steel column. The rebar-connectors that take the negative bending of the slab using the lower level of holes and the cross section of the transverse rebar-connectors can be seen. The support "chairs" for the rebar-connectors and the steel deck can also be seen.

FIG. 7. It is a perspective of how the support "chairs" of the rebar-connector look, and how they ring them around and how they bear on the steel deck.

DETAILED DESCRIPTION

Figure 1:
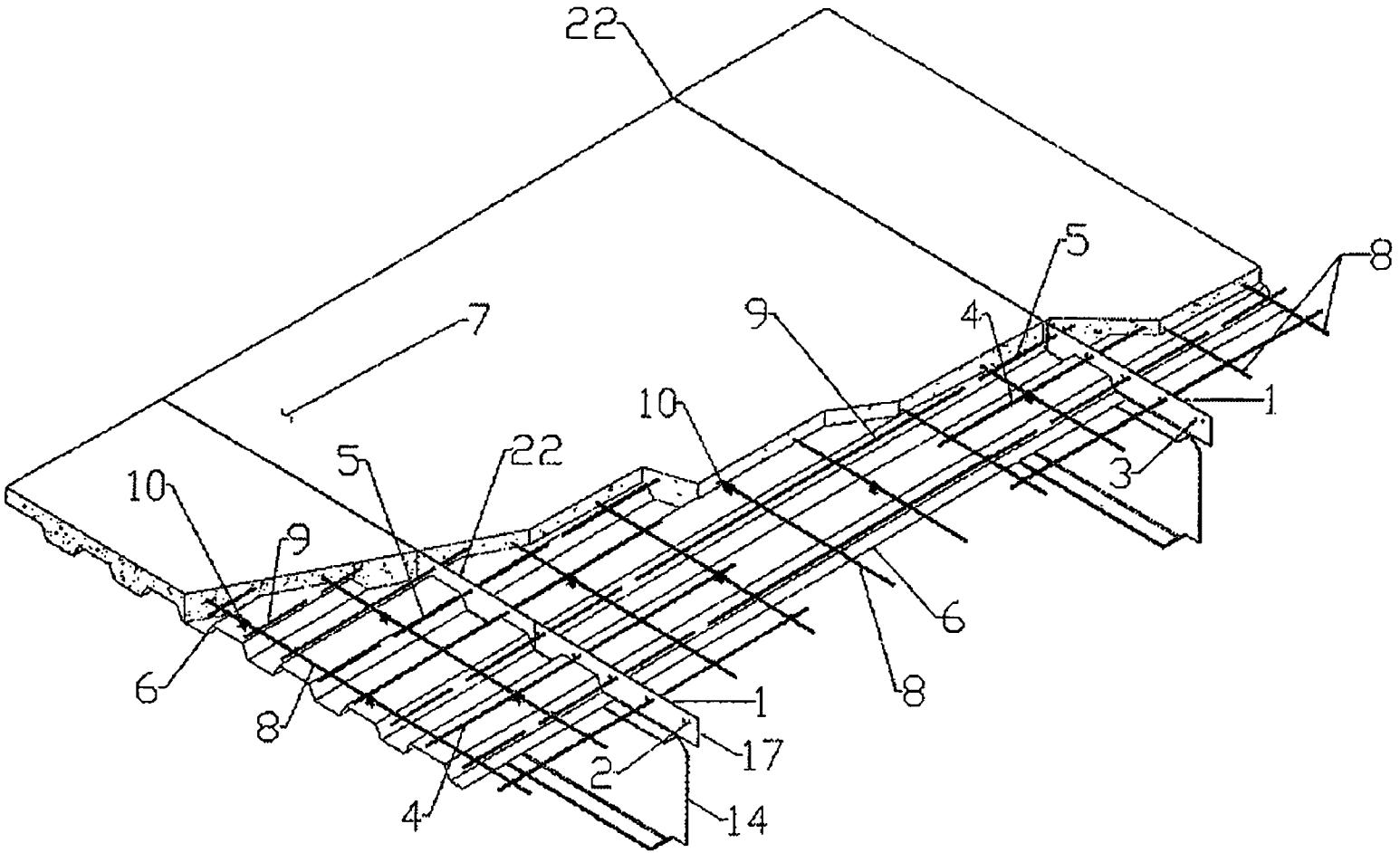
FIG. 1. It is a perspective of two parallel simply supported steel "I" beams with its plate-connectors welded to the top flanges; the long and short rebars are seen as they cross the holes of the plate-connector; all rebar-connectors are tied up with wires to the longitudinal rebars which are supported by "chairs" sitting on top of the steel deck's ridges transverse reinforcement for temperature can also be seen; reinforced concrete of the slab can also be seen with the edge of the plate-connector at the same finish level of the slab. Steel deck and its support on the beams can also be seen.
Figure 2:
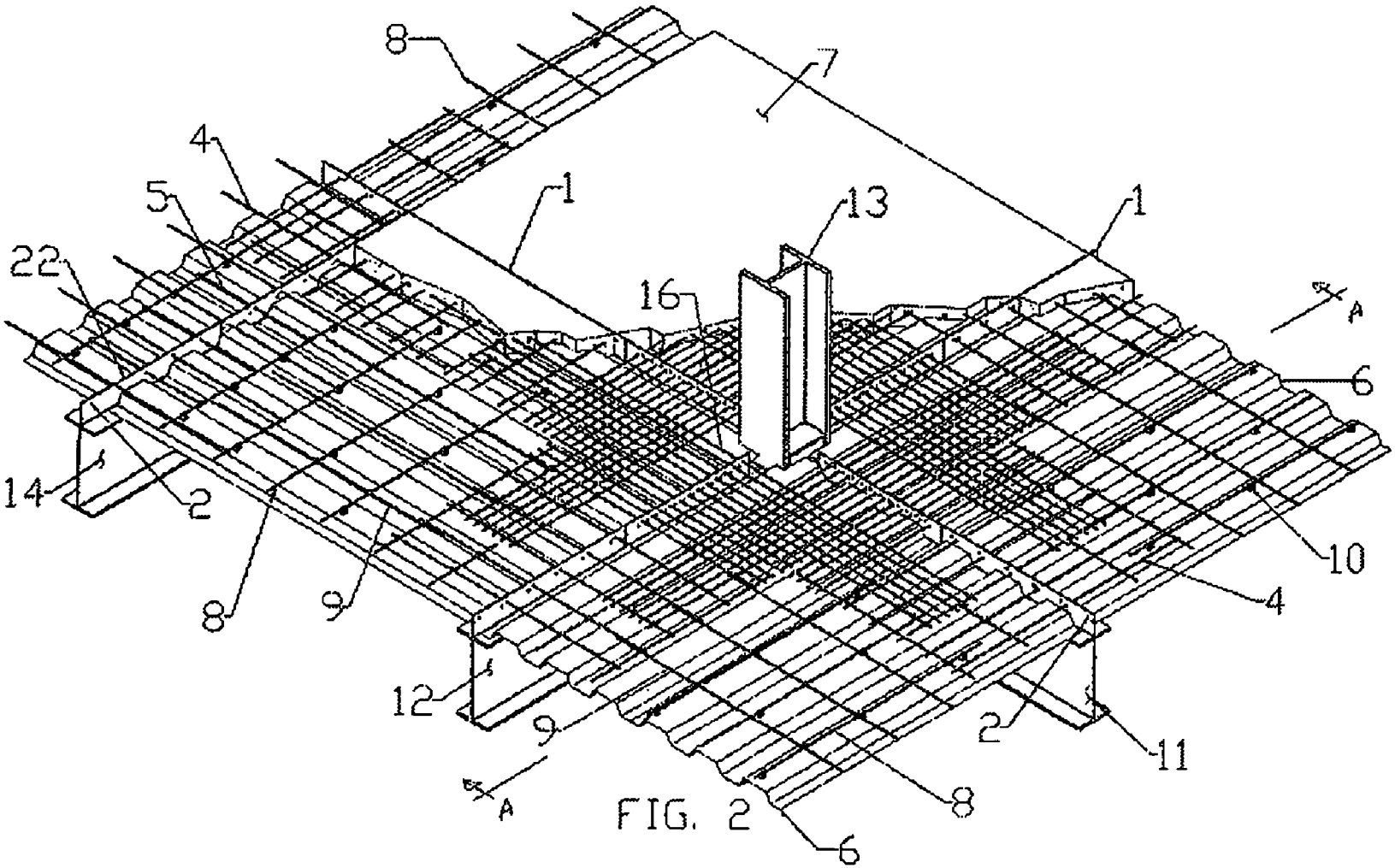
FIG. 2. It is a general perspective of the composite structural system since there are beams that frame to a column and there is a secondary beam being supported by a main beam. It can also be seen the long and short longitudinal rebar-connectors that take the negative flexural bending of the beam which perform at the same time as the rebar-connectors of the transverse beam. All the elements described in FIG. 1 can also be seen.
Figure 3:
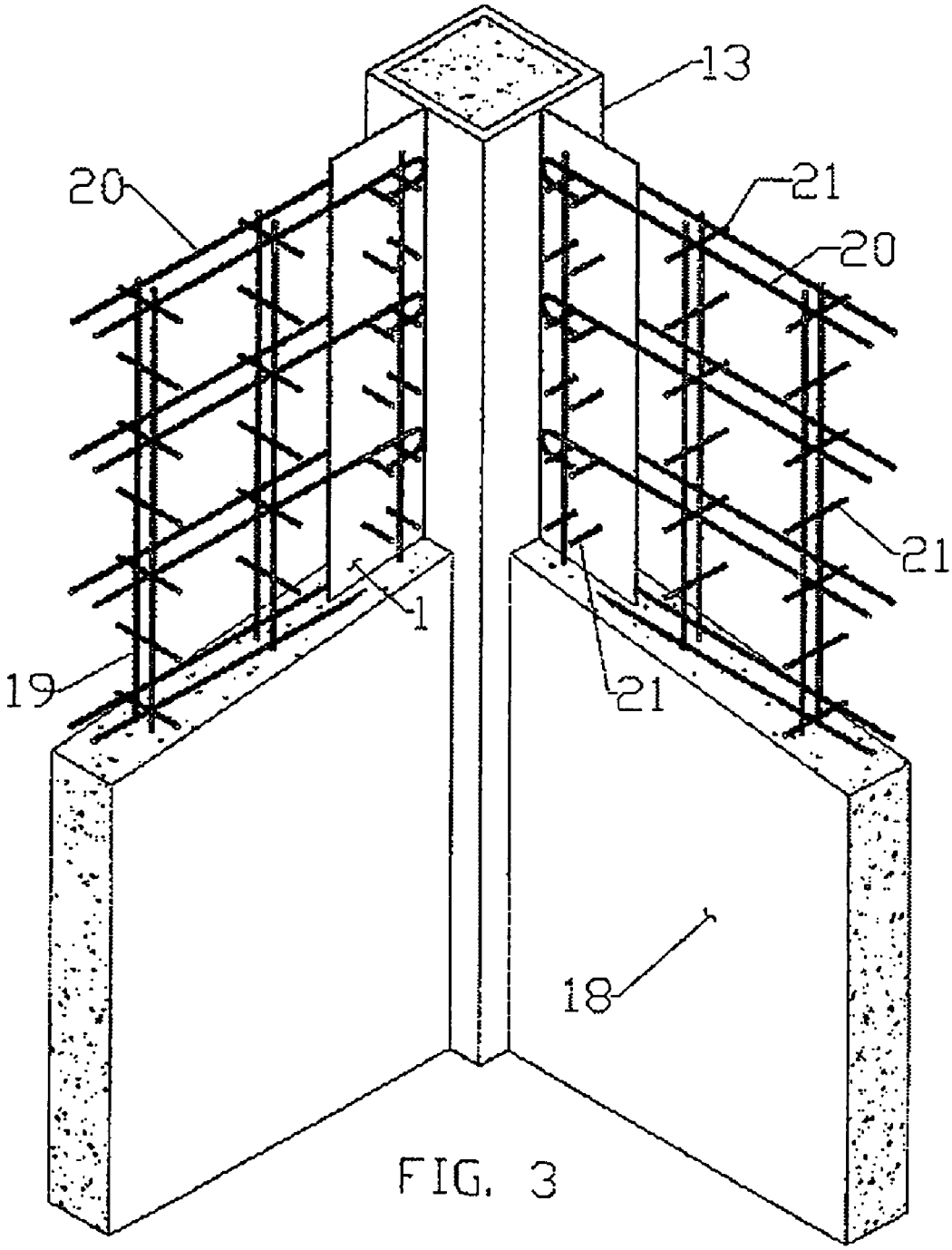
FIG. 3. It is a perspective of the connection between the steel composite column and the reinforced concrete diaphragm. The vertical rebars and the rebar-connectors that also perform as spacers for the formwork can be seen.
Figure 4:
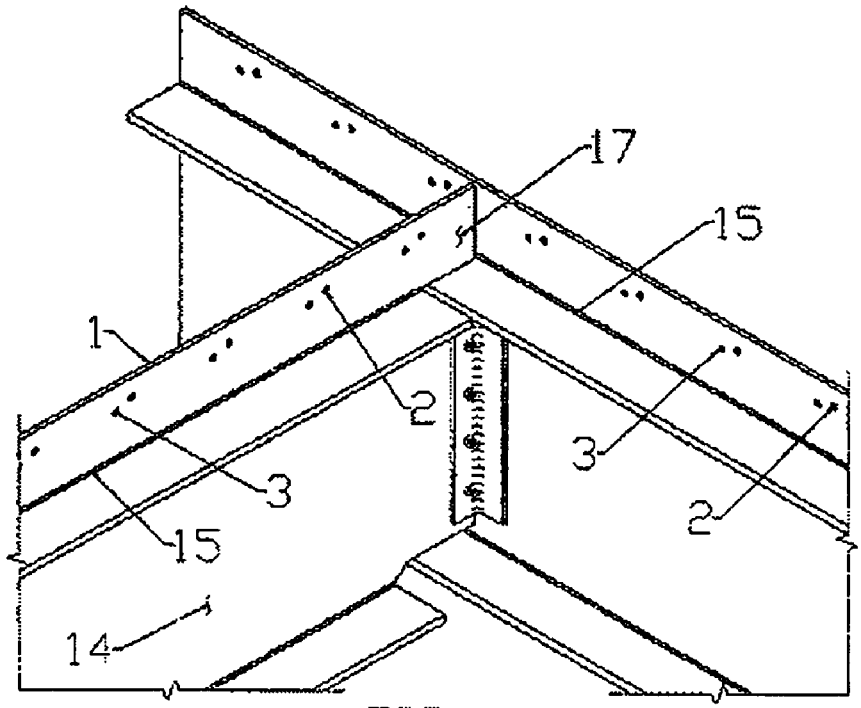
FIG. 4. It is a perspective that shows how the end extension of the plate-connector provides support to the secondary beam during erection by bearing these end extensions on the top flange of the main beam while keeping the finish level of the slab which is the same level of the top edge of the plate-connectors with holes.
Figure 5:
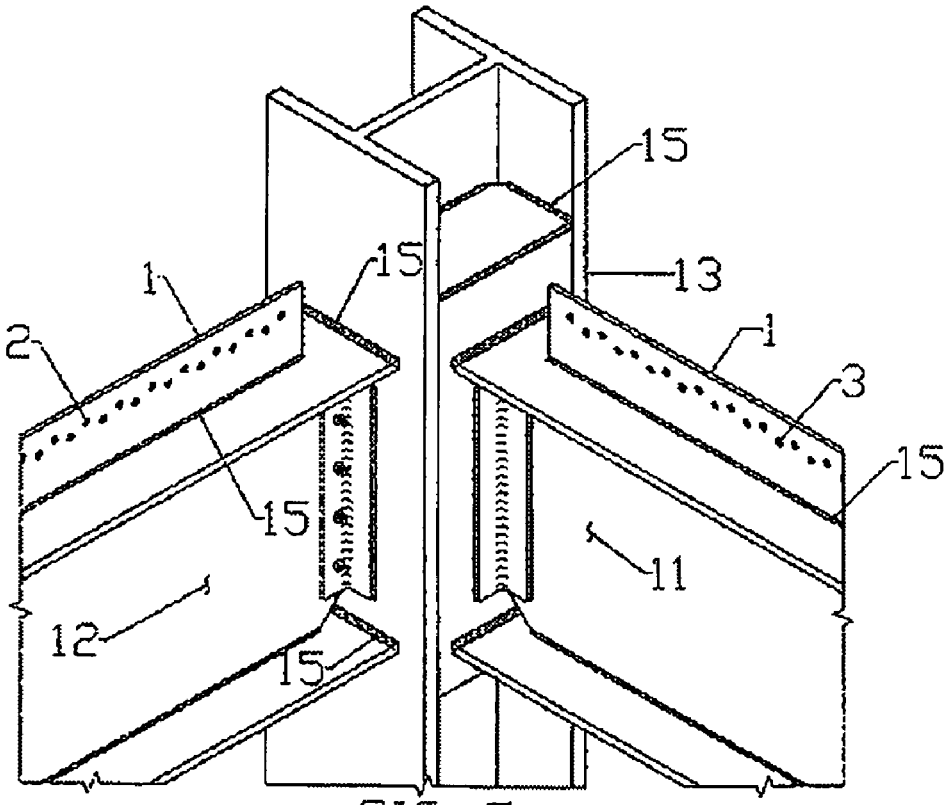
FIG. 5. It is a perspective of the connection of a steel column with the frame beams which take the negative flexure. The plate-connector with two levels of holes and the weld of the moment resistant connection that join the flanges of the beam to the faces of the columns can be seen.

The following description is demonstrative in nature and is not intended to limit the scope of the invention or its application of uses.

There are a number of significant design features and improvements incorporated within the invention.

In simply supported beams (14) the plate-connector (1, 22) with holes (2 and 3) is welded to the top flange of the beam (14) and in combination with the rebars (4 and 5) which go across the holes of the plate-connector it performs the following structural and constructive functions:

- The bottom half of the plate-connector (1, 22), in all its length, which equals the span of the beam and on its two faces, takes the compression due to the slab (7) negative flexural bending whose maximum value is located precisely in the vertical plane which coincides with the plane of the plate-connector (1, 22).
- The plate-connector (1, 22) takes in all its length and on its two faces, through sliding friction with the slab's concrete, the longitudinal horizontal and vertical shear stresses of the composite beam up to the allowable limits of these stresses.
- The plate-connector (1, 22) should have the required thickness to resist all the vertical and horizontal longitudinal shear of the composite beam.
- The plate-connector (1, 22) must have the required thickness to resist the bearing stress on the holes (2 and 3) which is caused by the rebar connectors as they work as complementary elements of the composite system resisting the excess of the longitudinal horizontal and vertical shear, not covered by bond and sliding friction between the reinforced concrete of the slab (7) and the plate-connector (1, 22).
- The fillet welds (15) that join the plate-connector (1) to the beam's (14) top flange must have the required section to resist the total longitudinal horizontal shear and all the composite beam's (14) vertical transverse shear.
- The plate-connector (1, 22) and the top flange can be cut in one piece from an I beam profile or it can be a steel plate of rectangular cross section welded edgewise to a beam's top flange of a steel I beam or to the top flange of a plate girder with equal or unequal flanges.
- The plate-connector (1, 22) can be welded to the beam's (14) top flange with one fillet weld at each side or only one fillet weld at one side, according to design and constructive facility.
- The plate-connector (1, 22) cantilevers out slightly at its ends (17) so these extensions can perform as beam supports during its erection: This support system allows to keep a constant level for all the concrete slab.
- The holes (2, 3) of the plate-connector (1, 2) hold in its correct position and level all the rebar-connectors (4, 5) during the concrete pouring of the slab (7) and this guarantees that the calculated negative flexural bending strength of the slab (7) becomes a reality because its flexural arm will be exactly in the design position and complying with code cover-over-bars requirements; this structural and constructive system eliminates the typical cracks which appear in slabs along the beam's (14) longitudinal axis in regular composite systems; these cracks are the result of the difficulty in maintaining the reinforcing wire fabric at its design horizontal position during the concrete pouring, in spite of the use of "chairs", and this is due to the great flexibility of the welded wire fabric, also product of the small diameters of its rebars.
- The rebar-connectors (4, 5) which go across the holes of the plate-connector (1, 22) take: In first place the tension caused by the transverse negative flexural bending of the slab (7) whose maximum is located precisely at the beam's axis (11); secondly the tension caused by shrinkage and creep in the concrete of the slab (7); in the third place the shear, the bearing and bond caused by the horizontal longitudinal shear stress in the composite beam (11) and in fourth place the bending, shear and bond caused by the vertical shear in the composite beam (11) which tries to separate it from the slab (7). The rebar connectors crossing the holes of the plate-connector (4) do not allow the separation of the plate-connector and the reinforced concrete, which can be the result of the simultaneous action of the slab's reinforced concrete flexural bending, the slab's drying shrinkage and creep, or the beam's longitudinal horizontal and vertical shear; the separation of the slab and the plate-connector, would eliminate bond and sliding friction which will produce the destruction of the integral composite system.
- The plate-connector (1, 22) may have only one level of holes (2) in the mid third of the span of the beam where rebar-connectors (4, 5) do not cross with other transverse rebar-connectors.
- Frame beams (11 and 12) with moment connections to columns (13), mostly in orthogonal directions, have a negative bending at the support, so the plate-connector (1, 22) with holes, welded to the top flange of the beams in combination with the rebars of the slab (16) which go across the plate-connector in two levels, meet the following objectives:
- The rebar-connectors (4, 5) take the tension caused by the beam's (11) longitudinal negative flexure and, at the same time, by means of the plate-connector (1, 22), the shear, bond and bearing, product of the transverse beam (12) horizontal shear and vice versa: the maximum tension in rebar connectors (4) is limited to one half of the usual shear strength when only tension is involved.
- The rebar-connectors (4) take the tension caused by shrinkage, creep and temperature changes in the slab in all directions.
- The rebar-connectors take the flexure, shear and bond caused by the vertical shear of the beam (11 and 12) which tries to separate it from the slab.
- The holes (2, 3) of the plate-connector secure that each layer of rebar-connectors (16) will be placed in its exact level, keeping the mechanical arm fixed and therefore, the maximum calculated flexural bending capacity for each beam (11 and 12) and the code concrete cover.
- The rebar-connectors (16) control the slab (7) cracking due to flexural bending or to diagonal tension in its plane caused by shear stress in both directions.
- The rebar-connectors (16) can have different lengths which depends on the variation of the magnitude of the negative bending of the composite system along the axis of the beam.

The rebars (8) parallel to the beam's axis should be tied with steel wire to the rebar-connectors (4 and 5) and the rebars of the bottom (8) should be supported by "chairs" (10); the system performs with the following functions:

- To keep all of the rebar-connectors (4 and 5) with a proper parallelism and angle in relation to the beam's axis.

To supply support and horizontal stability to rebar-connectors (3 and 4) during the pouring of the slab, the "chairs" (10) hold together these rebars (8) and give them support and spacing; the "chairs" should be placed on the top of the ridges of the steel deck (6).

To supply the slab (7) with the required reinforcement (8 and 9) in order to take the stresses caused by temperature changes.

To create a rebar mesh (8 and 9) with the transverse rebars (9) that go on top of the steel deck (6) but with those (9) that are not rebar-connectors (14) and go across the top layer of holes of the plate-connector and (2 and 3) cover the central portion of the span of the slab along all its length (7): it is important to keep the splice of these transverse rebars (10), across the width of the slab's transformed section (7), in order to keep there the same longitudinal horizontal shear strength.

To distribute the stresses caused by point loads on the slab (9) thus avoiding cracking and disintegration in the reinforced concrete of the slab.

The plate-connector (1, 22) with holes crossed by rebar-connectors (21) and joined to a steel column profile (13) has the following structural functions:

The set plate-connector (1, 22) with its rebar-connectors across its holes solve all of the following forces: longitudinal shear, transverse shear, drying shrinkage and creep of the reinforced concrete diaphragm.

The rebar-connectors which go across the holes (2 and 3) of the plate-connector (1, 22) take in shear and bearing strength the longitudinal and transverse shear of the diaphragm (18) as well as the stresses caused by drying shrinkage and creep of the reinforced concrete (18) of the diaphragm.

The rebar-connectors across the plate-connector (1, 22) with their length define the diaphragm thickness (18) since they act like limits to the formwork.

The rebar-connectors (21) maintain the reinforced concrete bonded to the plate-connector (1, 22) preserving its sliding friction and bond.

The holes (2 and 3) of the plate-connector (1, 22) must have a minimal web diameter that would make possible the tightest rebar connectors manual fitting (21) to maintain the concept of bearing connector valid.

Although the present invention has been described in considerable detail with reference to certain preferred versions thereof, other versions are possible. Therefore, the point and scope of the appended claims should not be limited to the description of the preferred versions contained herein.

As to a further discussion of the manner of usage and operation of the present invention, the same should be apparent from the above description. Accordingly, no further discussion relating to the manner of usage and operation will be provided.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. An integral composite-structure construction system for building floors or roofs which comprises:

a plurality of steel I beams with plate-connectors having two layers of holes and said plate-connector welded edgewise along beam's axis to an upper face of a top flange of said steel I beams; rebars which go across the holes of said plate connectors; a steel deck bearing on an upper face of said top flange of said steel I beams at left side and right side of said plate-connectors with said holes; supporting chairs which hold said rebars of a bottom layer and bearing on ridges of said steel deck, steel wire tying crossings of the longitudinal and transverse of said rebars; concrete slab encasing said rebars and said chairs and leveled up to a top edge of said plate-connector and resting on said steel deck where a plate-connector is welded edgewise along the axis of said steel I beam; each of said plate connectors has several pairs of holes conforming two layers of holes with the first layer of holes located at a fixed distance measured from the top edge of said plate-connector to the horizontal top tangent of top layer holes; wherein the bottom layer of said holes is located at a distance of one hole diameter measured vertically center to center of holes of the two said layers; with a minimum distance center to center of holes for each pair of holes measured horizontally being three hole diameters; the minimum distance measured horizontally center to center between two holes in sequence of the top layer or of the bottom layer holes is six hole diameters; with said holes having the same diameter, where the rebars go across the holes of top and/or bottom layer of holes of the plate-connector; where the diameter of the holes is slightly larger than the outside diameter of the rebars where the top edge of the plate-connector is the finish level of the concrete of the slab where the ends of the plate-connector are extended beyond the ends of said steel I beam as erection supports of said steel I beam, where the plate-connector is a construction joint of the reinforced concrete slab covering open ends of the left side and of the right side of said steel deck seating on each half of the top flanges of the plurality of said steel I beams, where the plate-connector has only the upper level of holes for beams or parts of beams with only positive flexural bending, where the rebars parallel to the beam's axis are tied with steel wire to the rebar-connectors and the rebars of the bottom are supported by said chairs to keep all of the rebar-connectors with a proper parallelism and angle in relation to the beam's axis that support and horizontal stability to rebar-connectors during pouring of the slab to supply the slab with reinforcement in order to take stresses caused by temperature changes.

* * * * *